United States Patent [19]

Culp, Sr. et al.

[11] Patent Number: 4,934,240

[45] Date of Patent: Jun. 19, 1990

[54] BRAIDING APPARATUS

[75] Inventors: Carl H. Culp, Sr., Vienna; Steven M. Hastings, Springfield; Richard T. Brown, Manassas, all of Va.

[73] Assignee: Atlantic Research Corporation, Alexandria, Va.

[21] Appl. No.: 430,238

[22] Filed: Oct. 30, 1989

[51] Int. Cl.[5] ..... D04C 3/00; D04C 1/06

[52] U.S. Cl. ..... 87/33; 87/1; 87/8; 87/28; 87/34

[58] Field of Search ..... 87/8, 1, 23, 28–30, 87/33, 34; 139/11, 13 R, 16, 55.1

[56] References Cited

U.S. PATENT DOCUMENTS 3,426,804 2/1969 Bluck ..... 87/33

4,312,261 1/1982 Florentine ..... 87/33

4,753,150 6/1988 Brown ..... 87/33

*Primary Examiner*—John Petrakes

*Attorney, Agent, or Firm*—Frank P. Presta

[57] ABSTRACT

Apparatus for braiding an article from a plurality of fibers, comprising a plurality of flexible annular members of substantially the same size which are disposed side-by-side in axially aligned relation and have means for supporting fiber carriers for axial movement relative thereto. The annular members are mounted for circumferential movement about a common central axis relative to each other. A plurality of rows of fiber carriers are mounted on the annular members for axial movement relative to the annular members. Actuating means are provided to move the annular members and to move the rows of fiber carriers axially in a predetermined manner to intertwine the fibers.

6 Claims, 3 Drawing Sheets

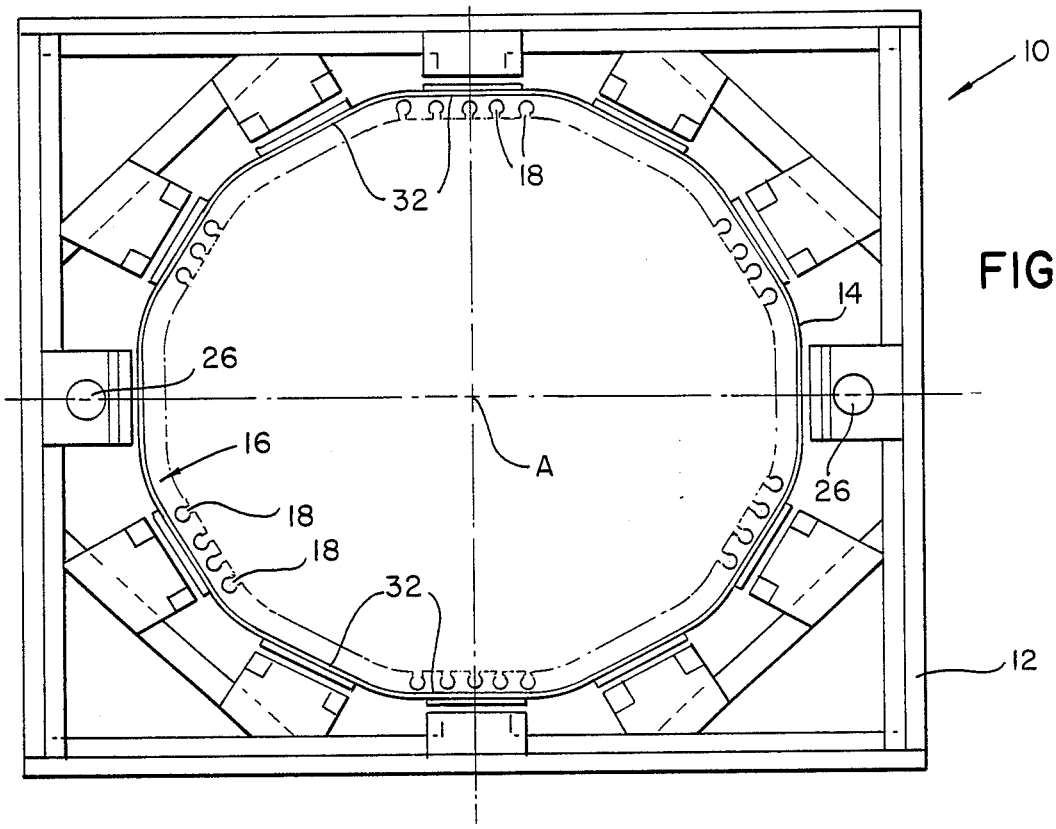
FIG. 1
FIG. 2
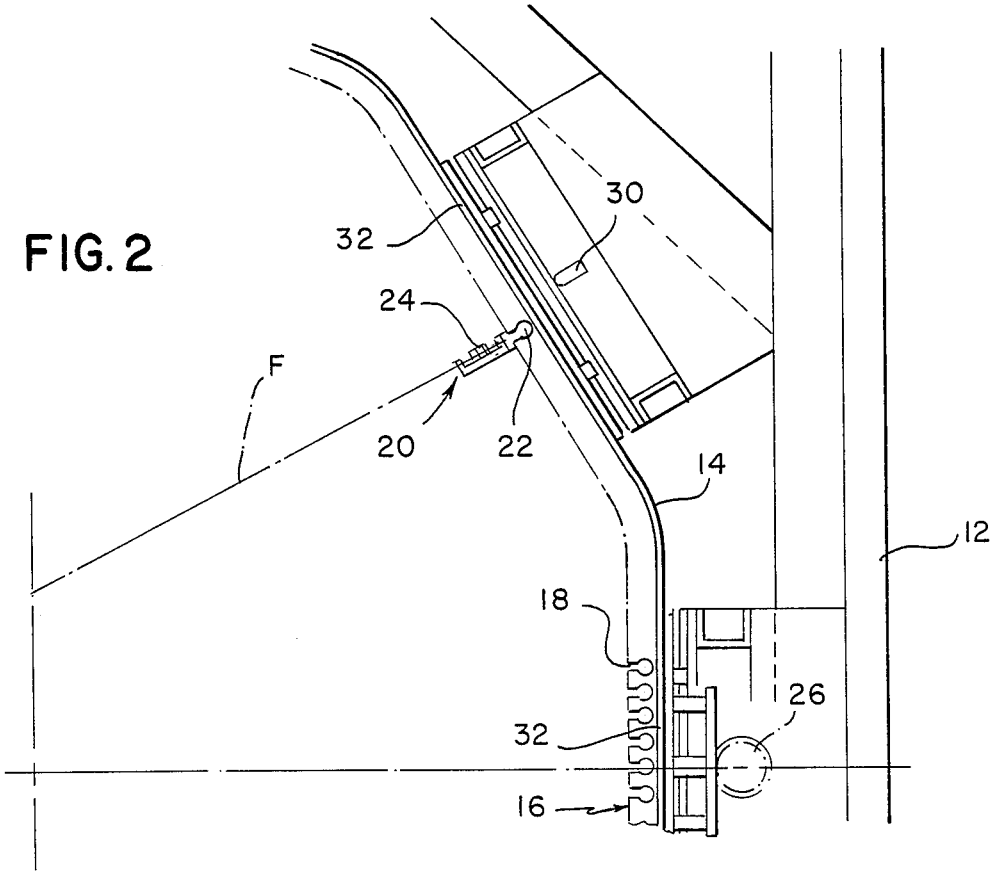

BRAIDING APPARATUS

BACKGROUND OF THE INVENTION

The present invention relates to multi-ply braiding apparatus and, more particularly, to a braiding apparatus wherein a matrix of fiber carriers are arranged generally in a multi-sided configuration, each carrier transported loosely by a flexible belt or other low tolerance mechanism.

Multi-ply braiding concepts and machines are disclosed in the patents to Bluck No. 3,426,804; Florentine No. 4,312,261; and Brown No. 4,753,150 the teachings of which are incorporated herein by reference. In the teachings of Bluck, Florentine and Brown, circular (continuous) braiding machines can consist of discrete, circular arrangements of cog wheels (Bluck) or arrays of circular (Florentine) or cylindrical (Brown) rings. Each of these devices is characterized by a rigid, close dimensional tolerance between the mechanisms, cog wheels or rings which transport the fiber carriers. When machines of very large fiber carrying capacity are built, it is difficult to fabricate the ring or cog wheel assemblies to close enough tolerances on this scale so that the components fit together properly and allow smooth transfer of fiber carriers from ring to ring or wheel to wheel.

Accordingly, a need has arisen for a new and improved braiding apparatus of the circular (continuous) type, having fiber transfer elements with a low, loose tolerance relationship to each other. This need is filled by the flexible belt-type, multi-sided braiding apparatus of the present invention.

SUMMARY OF THE INVENTION

The braiding apparatus of the present invention comprises an array of flexible, generally annular members or belts that are of substantially the same perimeter and located side-by-side in axially aligned relation. Fiber carrier members or shoes are slidably movable in circumferentially spaced slots in the belts for axial movement relative thereto.

In the braiding process, fibers are intertwined by moving adjacent rows of fiber carrier shoes in opposite axial directions and by moving adjacent belts in opposite circumferential directions in a predetermined manner. An actuation mechanism coarsely moves adjacent belts to a position near where belt to belt sliding of shoes is possible. The degree of accuracy of alignment is related to the deliberately low, loose tolerance of the belt assembly.

Precise positioning of slot to slot is accomplished on a local sector-by-sector or facet-by-facet basis, as needed. In one embodiment, sensors are mounted on each belt, one sensor per facet segment. The mounted slots are closely aligned or toleranced to the nearest sensor. Belt to belt tolerancing is not relevant. After coarse belt shifting is accomplished, the actuation system finely positions the sensors one to another in one sector or facet. The shoes are then exchanged between belts in that sector or facet only. The actuation system subsequently positions the sensors and shifts shoes in the next facet, working facet by facet to the original starting position. In this fashion, the control system is used to correct locally for an out of tolerance slot to slot condition.

BRIEF DESCRIPTION OF THE DRAWINGS

FIG. 1 is a partially schematic end elevational view of one embodiment of a braiding apparatus constructed in accordance with the principles of the present invention;

FIG. 2 is an enlarged end elevational view of the apparatus in the Detail A portion of FIG. 1;

DESCRIPTION OF THE PREFERRED EMBODIMENTS

Figure 3:
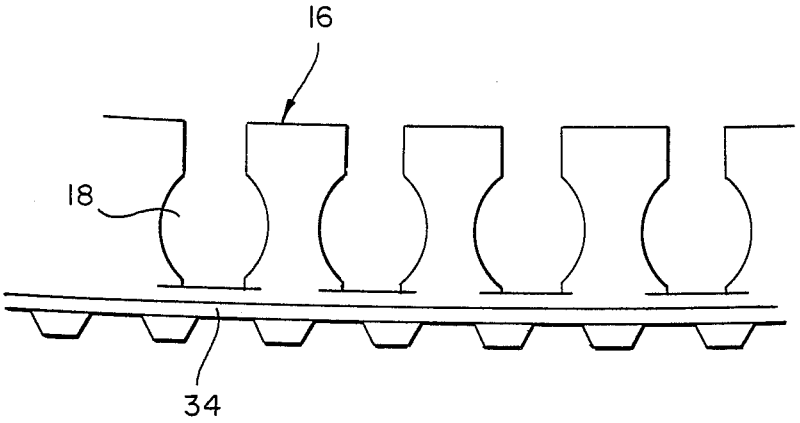
FIG. 3 is an enlarged side elevational view of a portion of a flexible belt of the braiding apparatus shown in FIGS. 1 and 2.

The braiding apparatus 10 of the present invention is generally similar in construction and operation to the braiding apparatus disclosed in the Brown Patent No. 4,753,150. As shown in FIGS. 1 and 2, the present braiding apparatus 10 generally comprises a support frame 12 of any suitable construction and a plurality of track members 14 or other suitable supports mounted on the frame 12 for the purpose of rotatably or movably supporting a plurality of generally annular members 16 of substantially the same size that are disposed side-by-side in axially aligned relation for rotation or movement about a common axis A. The term "annular" as used herein is intended to mean any ring-like shape such as oval, round or faceted.

Each of the annular members 16 may be provided with a plurality of circumferentially spaced, axially extending tracks or grooves 18 extending therethrough. A plurality of fiber carrier members 20 (FIG. 2) comprise rollers 22 or the like at one end thereof that are slidably mounted in the tracks 18 on the annular members 16. Rotatable fiber spools 24 are connected to the rollers 22 of the fiber carriers 20 and extend generally radially inwardly from the annular members 16 so that fiber F can be fed inwardly from the spools 24 to form the article to be braided (not shown).

In the operation of the braiding apparatus 10 of the present invention, the fibers F being fed inwardly from the spools 24 are intertwined to form the braided article (not shown) by moving or rotating the annular members 16 relative to each other and by moving the rows of fiber carriers axially in a predetermined manner depending on the braiding pattern desired. The annular members 16 may be moved or rotated about the axis A by any suitable type of manually or power driven actuator 26 which is connected to them in any suitable manner, such as through a suitable gearing arrangement (not shown).

The rows of fiber carrier members 20 may be moved axially through the tracks or grooves 18 in the annular members 16 by any suitable actuating means, such as slidable rods or pistons (not shown) that are disposed at opposite ends of the fiber carrier member rows for slidably moving the rows axially in a predetermined manner relative to each other. The actuators may be driven by any suitable means (not shown), such as by mechanical or pneumatic drive means.

As taught in the Bluck and Florentine patents, empty spaces (not shown) are provided at the ends of the fiber carrier member rows to accommodate the shifting of the rows. As an illustrative example, these empty spaces could be provided in the annular members at the ends of the present braiding apparatus and the end annular members would not be rotatable.

As an illustrative example, the actuating drive means 26 may be constructed to move or rotate adjacent annular members 16 in opposite directions through a predetermined distance, and the actuating means may be constructed to move adjacent rows of carrier members 20 in opposite axial directions through a predetermined distance to intertwine the fibers F extending inwardly from the spools 24. Examples of such braiding patterns are shown in FIG. 3 of the Bluck patent and in FIGS. 5 and 9 of the Florentine patent. Within the scope of the present invention, the spools 24 could extend outwardly from the annular members 16 so as to intertwine the fibers F toward one or both sides of the braiding apparatus, as shown in FIG. 3 of Patent No. 4,753,150.

The generally cylindrical apparatus of the present invention is particularly advantageous in that all of the annular members 16 are of substantially the same size and construction so as to be readily interchangeable and expandable. Also, the braiding apparatus 10 of the present invention requires far less space than the conventional, flat circular braiding apparatus and is capable of braiding axisymmetric and cartesian structures.

In accordance with the present invention, the annular members 16 are of flexible construction and precise positioning of the slots 18 therein is accomplished on a local sector-by-sector or facet-by-facet basis, as needed, so that it is not necessary for adjacent annular members to be closely toleranced to each other. As an illustrative example, sensors 30 of any suitable type are mounted on the frame 12 and the annular flexible members 16 in predetermined segments or facets 32, and the slots 18 in the annular members 16 are closely aligned or toleranced to the nearest sensor. In this manner, the actuation system positions sensors one to another in one sector or facet 32 so that the slots 18 in that sector or facet are axially aligned to permit movement of the fiber carrier members 20 from one annular member to another in that sector or facet. The actuation system subsequently positions the sensors and shifts the fiber carrier members in the next sector or facet, working sector-by-sector or facet-by-facet to the original starting position. This system, therefore, corrects locally for an out of tolerance slot-to-slot condition in adjacent annular members 16.

Figure 4:
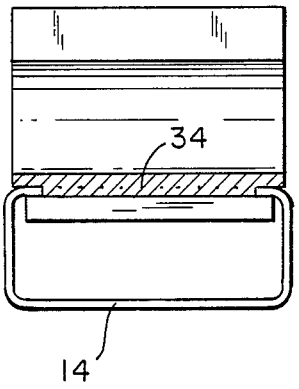
FIG. 4 is an end elevational view, partly in section, of the belt of FIG. 3 movably mounted on a track member.

As shown in FIGS. 3 and 4, each annular member 16 may be a flexible belt 34 formed of any suitable material such as a plastic or rubber material. The belt 34 may be slidably mounted in any suitable manner on a track member 14 of generally U-shaped cross section, as specifically shown in FIG. 4.

Figure 5:
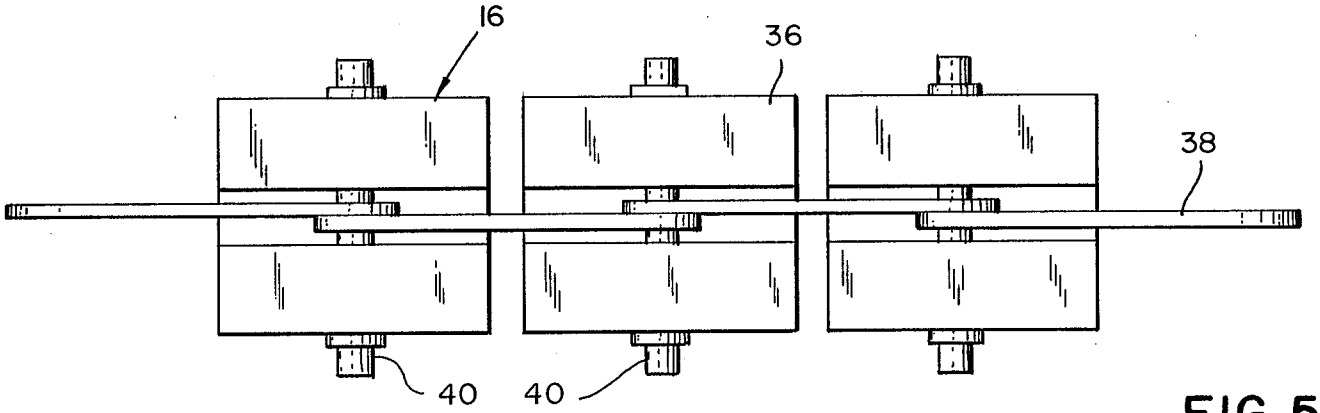
FIG. 5 is a plan view of a portion of a modified belt construction of the link type.
Figure 6:
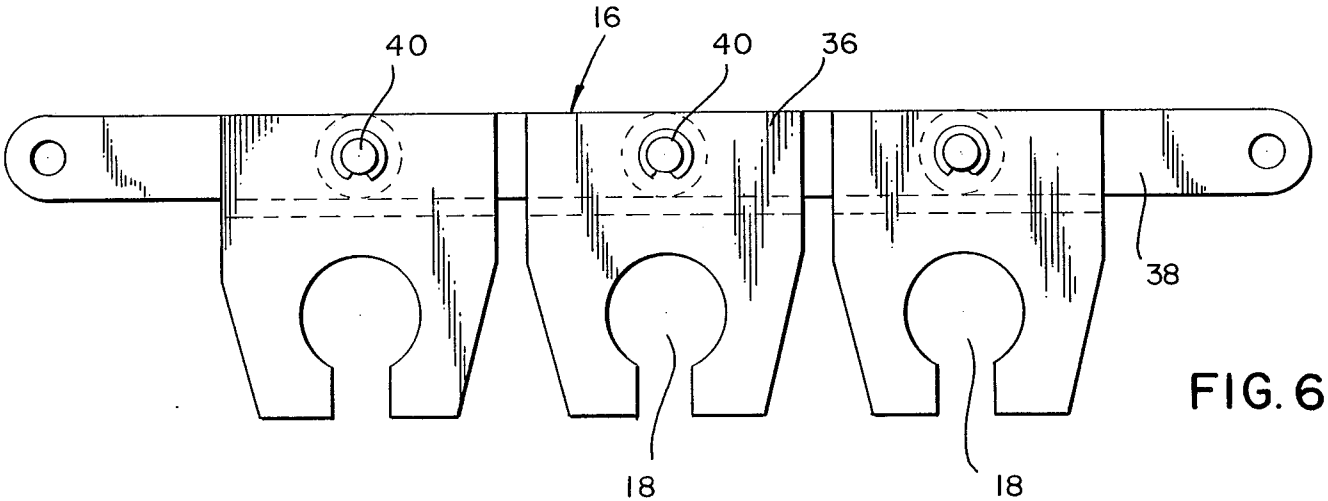
FIG. 6 is a side elevational view of the modified belt portion shown in FIG. 5.

In an alternate embodiment shown in FIGS. 5 and 6, each annular member 16 may be in the form of a flexible chain 36 having links 38 and pins 40 adapted to be slidably mounted on a suitable track member (not shown). It is apparent that the annular members 16 could be formed of other suitable flexible constructions within the scope of the present invention.

We claim:

1. Apparatus for braiding an article from a plurality of fibers, comprising:

a plurality of flexible, generally annular members of substantially the same size, said annular members being disposed side-by-side in axially aligned relation and having means for supporting fiber carriers for axial movement relative thereto;

track means for slidably supporting and guiding said annular members for circumferential movement about a substantially common central axis relative to each other;

a plurality of rows of fiber carriers mounted on said annular members for axial movement relative thereto; and actuating means to move said annular members circumferentially and to move said rows of fiber carriers axially in a predetermined manner to intertwine the fibers.

2. The apparatus of claim 1 wherein said means for supporting fiber carriers are circumferentially spaced, axially extending slots in said annular members, and said fiber carriers are slidably mounted in said slots.

3. The apparatus of claim 2 wherein a plurality of sensors are mounted in circumferentially spaced relation on each of said annular members, and a plurality of sensing means are mounted in surrounding relation to each annular member to align slots in adjacent annular members for axial movement of fiber carriers from one annular member to another.

4. The apparatus of claim 3 wherein said annular members are flexible belts.

5. The apparatus of claim 1 wherein said annular members are flexible belts.

6. The apparatus of claim 1 wherein said actuating means is constructed to move adjacent annular members in opposite circumferential directions and to move adjacent rows of fiber carriers in opposite axial directions.

* * * * *